United States Patent [19]

Naya et al.

[11] Patent Number: 4,486,631

[45] Date of Patent: Dec. 4, 1984

[54] CONTACT FOR VACUUM CIRCUIT BREAKER

[75] Inventors: Eizo Naya, Ibaragi; Toshiaki Horiuchi, Settsu; Yasushi Takeya, Osaka; Kouichi Inagaki, Itami; Michinosuke Demizu, Takarazuka; Mitsuhiro Okumura, Sakai, all of Japan

[73] Assignee: Mitsubishi Denki Kabushiki Kaisha, Tokyo, Japan

[21] Appl. No.: 452,052

[22] Filed: Dec. 22, 1982

[30] Foreign Application Priority Data

Dec. 28, 1981 [JP] Japan ..... 56-215827

[51] Int. Cl.[3] ..... H01H 33/66

[52] U.S. Cl. ..... 200/144 B; 200/266

[58] Field of Search ..... 200/144 B, 266

[56] References Cited

U.S. PATENT DOCUMENTS 3,551,622 12/1970 Takeuchi et al. ..... 200/144 B
3,960,554 6/1976 Gainer, Jr. ..... 419/27
4,302,514 11/1981 Kato et al. ..... 428/569

FOREIGN PATENT DOCUMENTS 147481 11/1979 Japan ..... 200/144 B

*Primary Examiner*—A. D. Pellinen
*Assistant Examiner*—Morris Ginsburg
*Attorney, Agent, or Firm*—Wenderoth, Lind & Ponack

[57] ABSTRACT

A contact for a vacuum circuit breaker is disclosed which contains copper as a first component and also at least two elements of the group of chromium, molybdenum, and tungsten as the other components. Each of these other components is contained in an amount not greater than 40% by weight.

4 Claims, 9 Drawing Figures

CONTACT FOR VACUUM CIRCUIT BREAKER

BACKGROUND OF THE INVENTION

This invention relates to a contact for a vacuum circuit breaker which has a high breakdown voltage and excellent large current characteristics.

The contact for the vacuum circuit breaker has to satisfy the following characteristic requirements:

(1) The interrupting performance should be high.
(2) The breakdown voltage should be high.
(3) The contact resistance should be low.
(4) The fusing force should be low.
(5) Wear should be low.
(6) The chopping current should be low.

However, it is difficult to meet all these requirements with an actual contact, and generally contacts which can meet only particularly important characteristics are used for specific applications while more or less sacrificing the other characteristics.

Heretofore, copper-chromium alloys (hereinafter referred to as Cu-Cr, similar element symbol expression being used for other elements and alloys of elements as well), Cu-Co, Cu-Bi, Cu-Cr-Bi, Cu-Co-Bi, etc., have been used for vacuum circuit breaker contacts. As a result of experiments conducted by the inventors, however, it is found that contacts which do not contain a low-melting metal such as Cu-Cr, and the like have a disadvantage that the fusing force is somewhat high even if they have a good interrupting performance, while contacts containing a low-melting metal, such as Cu-Bi and the like also have such disadvantages that the chopping current is somewhat high if the content of the low-melting metal is less than or equal to 1% by weight, and the interrupting performance and breakdown voltage are sacrificed if the content of the low-melting metal is more than 1% by weight.

Conventional contact alloys have been composed of Cu which is a good electric conductor, and such elements as Cr, Co, Bi and the like, which do not form a solid solution with Cu in order to prevent the reduction of electric conductivity. As a result, when these alloys are produced by a melting technique, it results in precipitation type metal structures having large size coarsely distributed grains. Generally, the finer and the more uniform the contact alloy in the metal structure, the better the interrupting performance, the breakdown voltage, and the chopping current. For this reason, the alloy obtained by the melting process is usually subjected to a heat treatment or to pulverization followed by sintering treatment in order to obtain an alloy which is uniform and fine in metallic grain structure. On the other hand, in the case of the powder sintering technique, an alloy having a uniform, fine grain metallic structure is obtained by previously employing powders having small particle sizes as the raw material.

However, these prior art contact alloys have limitations on their breakdown voltage, large current characteristics, chopping current, and uniformity and fineness of their metal structure. Thus, strong need exists for a contact alloy having better characteristics.

SUMMARY OF THE INVENTION

The object of the present invention is to provide a contact for a vacuum circuit breaker, having excellent breakdown voltage performance and a large current characteristic in order to overcome the drawbacks of the prior art discussed above.

We have tried to manufacture alloys by using Cu as a first component and various metals as second, third and further components and have conducted experiments by assembling these alloys in vacuum circuit breakers. It was found, as a result, that alloys obtained by adding to Cu at least two elements selected from the group consisting of Cr, Mo, and W of Group VIA of the Periodic Table are superior in breakdown voltage and large current characteristics because grains which are finer and more uniform are produced and the high-melting metals are better contained therein.

The contact for a vacuum circuit breaker according to the invention is characterized by containing Cu as a first component and at least two elements selected from the group of Cr, Mo, and W as the other components, each of these other components being contained in the range of less than or equal to 40% by weight.

In a preferred embodiment of the contact for vacuum circuit breaker according to the invention, Cu is contained as a first component and Cr and W as the other components, with the content of Cr being in the range between 10 and 40% by weight and the content of W being in the range between 0.3 and 15% by weight. Further, these contacts for a vacuum circuit breaker preferably contain at least one element having a low melting point selected from Bi, Te, Sb, Tl, Pb and the like alloys of these metals and intermetallic compounds of these metals in a quantity not exceeding 20% by weight.

DESCRIPTION OF THE PREFERRED EMBODIMENTS

Figure 1A:
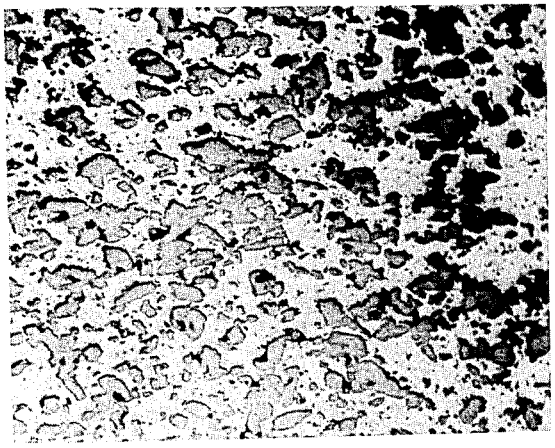
FIG. 1a PRIOR ART
FIG. 1*a* is a photomicrograph showing the structure of Cu-25 wt % Cr alloy manufactured by a prior art sintering process.
Figure 2A:
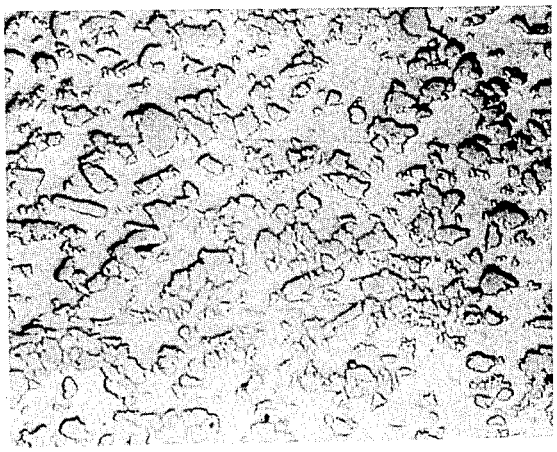
FIG. 2a PRIOR ART
FIG. 2*a* is a photomicrograph showing the structure of Cu-25 wt % Cr alloy manufactured by a prior art melting process.
Figure 1B:
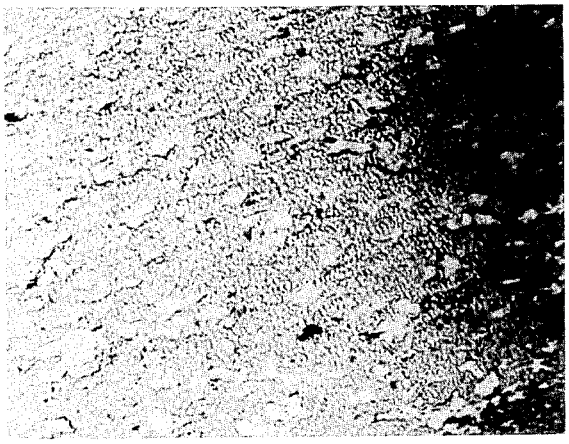
FIG. 1*b* is a photomicrograph showing the structure of Cu-24 wt % Cr-5 wt % W alloy according to embodiment of the present invention.
Figure 2B:
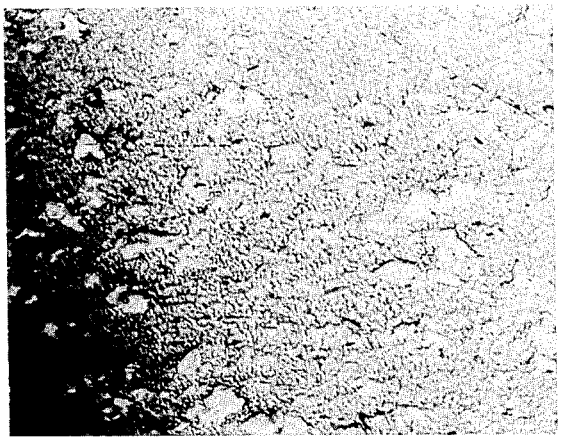
FIG. 2*b* is a photomicrograph showing the structure of Cu-24 wt % Cr-5 wt % W alloy according to another embodiment of the present invention.
Figure 3:
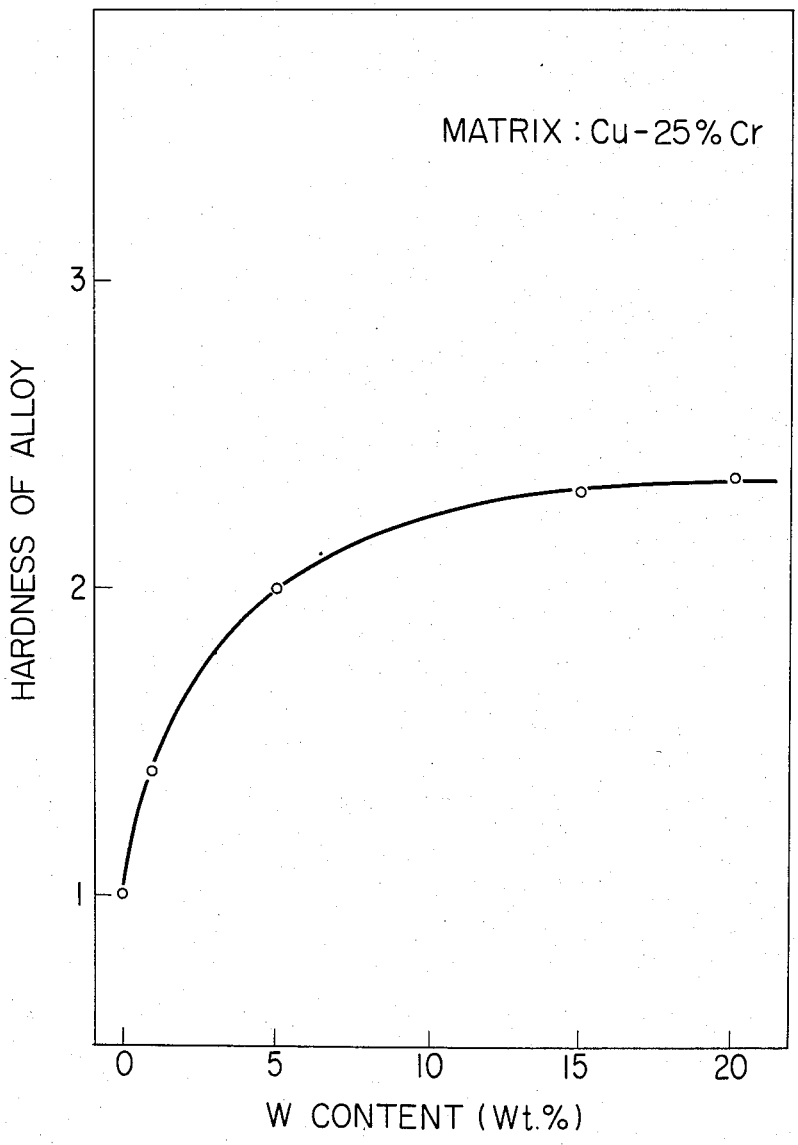
FIG. 3 is a graph showing the relation between the hardness and the content of W of a Cu-25 wt % Cr-W alloy.
Figure 4:
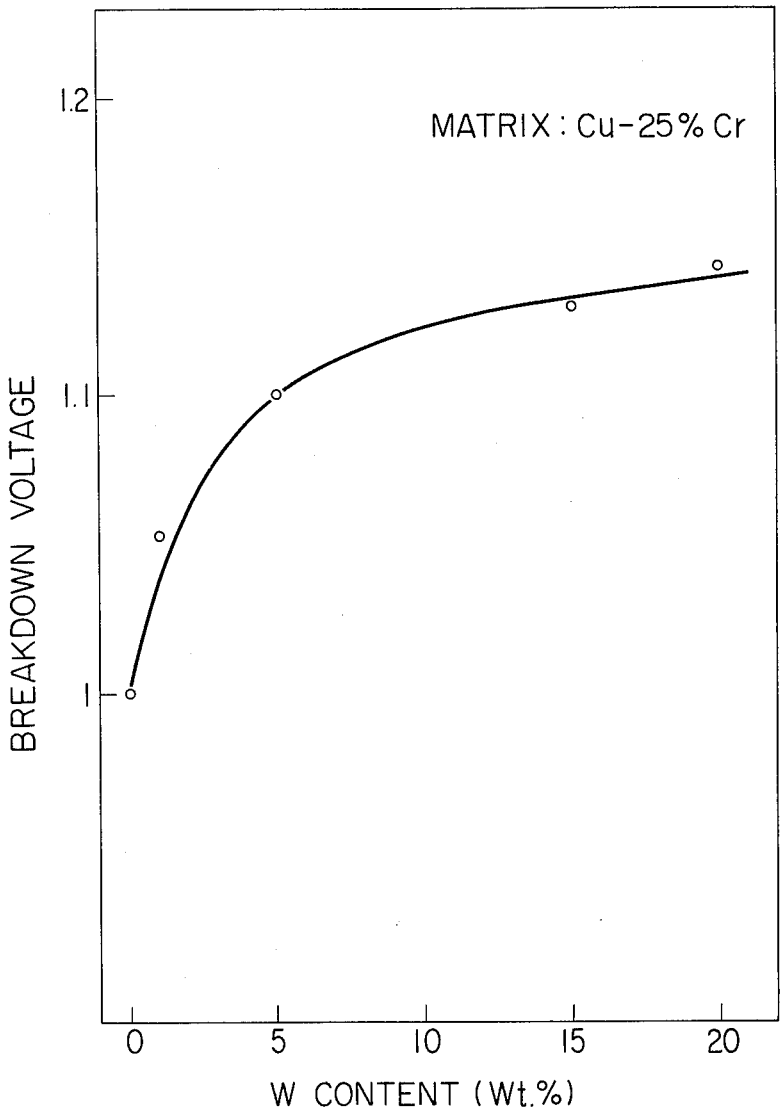
FIG. 4 is a graph showing the relation between the breakdown voltage and the content of W of a Cu-25 wt % Cr-W alloy.
Figure 5:
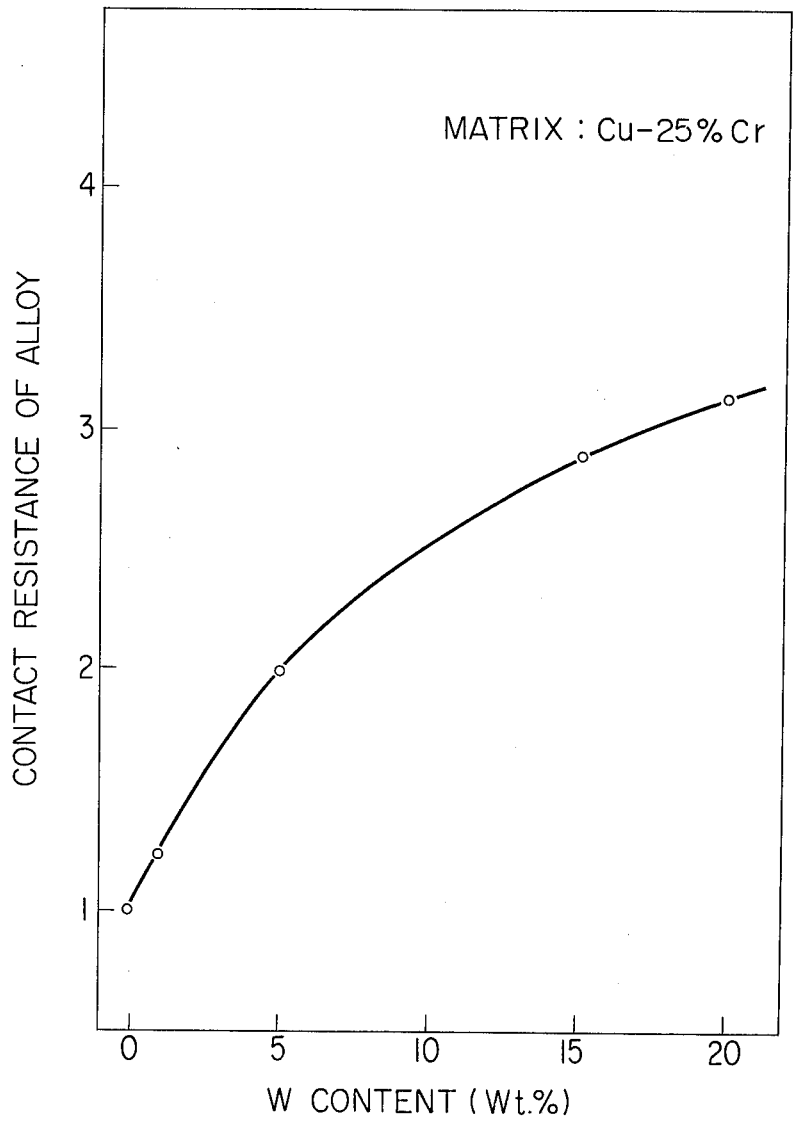
FIG. 5 is a graph showing the relation between the contact resistance and the content of W of a Cu-25 wt % Cr-W alloy.
Figure 6:
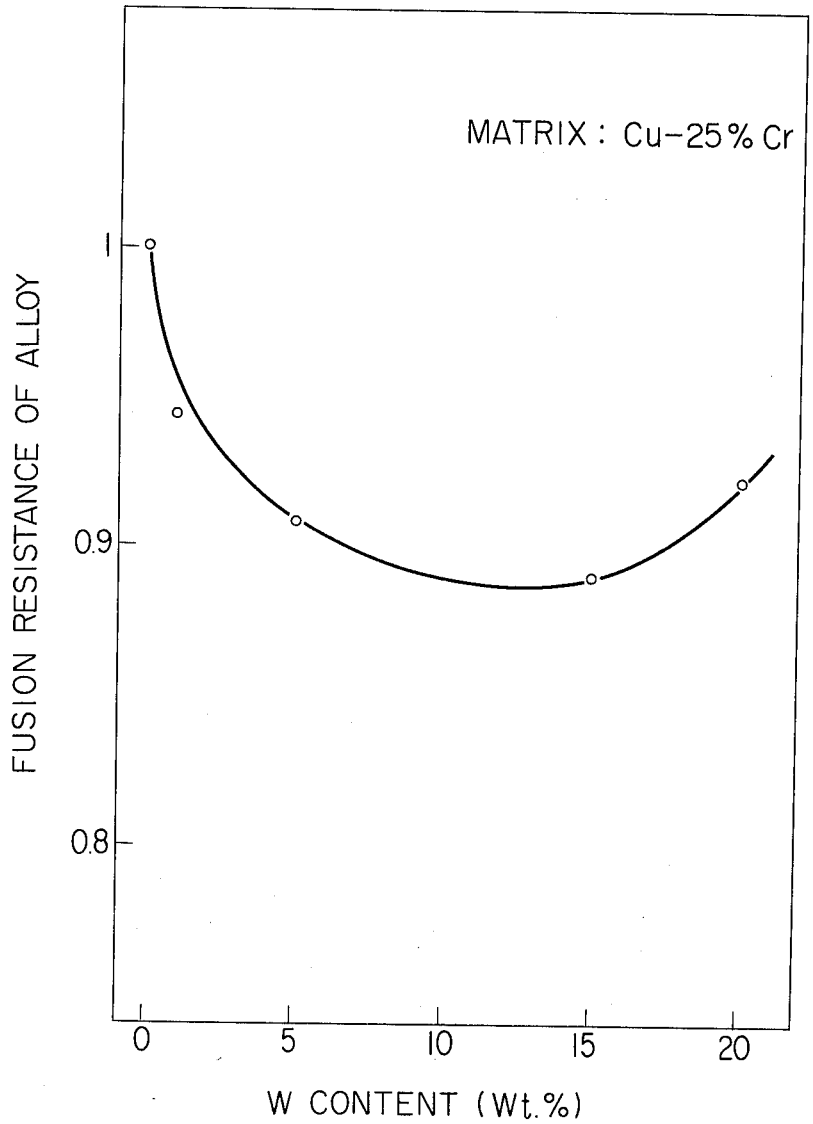
FIG. 6 is a graph showing the relation between the fusion resistance and the content of W of a Cu-25 wt % Cr-W alloy.

Hereinafter, there will be illustrated preferred embodiments of the invention. FIG. 1*a* is a photomicrograph (with a magnification of 100×) of the structure of a prior art Cu-Cr alloy. This Cu-Cr alloy is obtained by mixing 75% by weight of Cu particles and 25% by weight of Cr particles and molding and sintering the mixture. It has large, coarsely distributed, cloud-like Cr grains. FIG. 1*b* shows a picture (with a magnification of 100×) of a Cu-Cr-W alloy according to an embodiment of the present invention. This Cu-Cr-W alloy is obtained by mixing 71% by weight of Cu particles 24% by weight of Cr particles, and 5% by weight of W particles and molding and sintering the mixture. Its Cr grains are again cloud-like, but they are far smaller and more uniformly distributed compared to in the alloy of FIG. 1*a*. Cu grains are also smaller and more uniformly distributed. The alloys shown in FIGS. 1*a* and 1*b* are obtained by using the same lot of Cu and Cr particles as starting materials. Alloys obtained by the melting process show a similar trend. FIG. 2*a* show a photomicrograph (with a magnification of 100×) of the structure of a Cu-Cr alloy obtained by the prior art melting process, and FIG. 2*b* shows a photomicrograph (with a magnification of 100×) showing the structure of a Cu-Cr-W alloy according to one embodiment of the invention. The alloy components of FIG. 2*a* correspond to those of FIG. 1*a*, and the alloy components of FIG. 2*b* correspond to those of FIG. 1*b*. It will be seen from these photomicrographs that the component, W has a significant effect on both the uniformity and fineness of the grains. When the content of W is varied with Cu-25 wt % Cr as base, the uniformity and the fineness of the grain structure begin to develop from approximately 0.3 % by weight of the W content. As, the grain structure becomes finer and more uniform with the increase of the content of W, the characteristics of the alloy gradually change. Hereinafter the relations between the content of W and various characteristics of alloy will be discussed. FIGS. 3 shows the relation between the hardness and the content of W. It will be seen that the hardness is significantly increased compared to that of the prior art Cu-Cr alloy. FIG. 4 shows the relation between the breakdown voltage and the content of W. The breakdown voltage is increased with increasing W content. FIG. 5 shows the relation between the contact resistance and the content of W. The contact resistance increases with increasing W content. FIG. 6 shows the relation between the fusion resistance and the content of W. Improved fusion resistance can be obtained for a low W content range. However, the fusion resistance becomes inferior when the content of W is increased beyond about 15% by weight. It is thought from FIG. 5 that an increase in the W content increases the contact resistance to reduce the conductivity so as to increase the heat generation.

Figure 7:
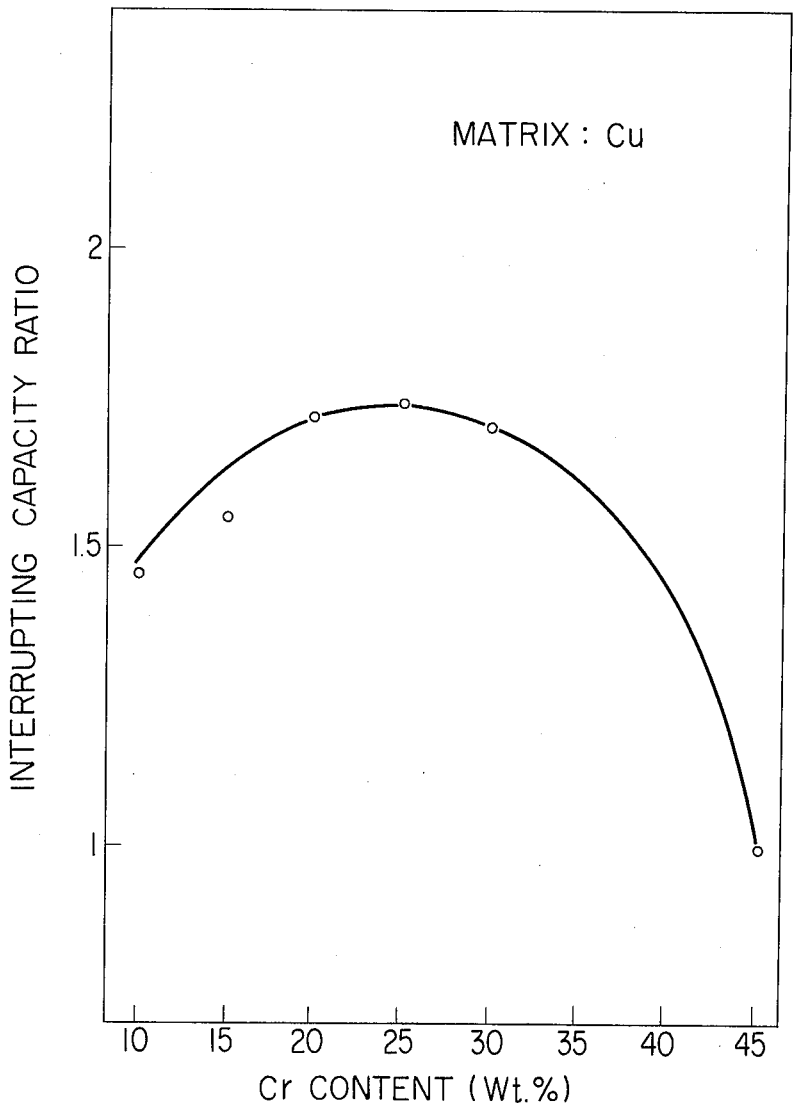
FIG. 7 is a graph showing the relation between the interrupting capacity and the content of Cr of a Cu-base alloy.

The characteristics discussed above have been obtained by adding W to a base alloy containing Cu and Cr in weight proportions of 75:25. Similar effects may be obtained by varying the content of Cr. FIG. 7 shows the relation between interrupting capacity and the content of Cr. As can be seen from the graph, Cr does not have an outstanding influence on the interrupting performance so long as its content is in a range of 10 to 40% by weight. Similar effects to those discussed above can be obtained with alloys which contain Cu as a first component and two or more elements of a group consisting of Cr, Mo, and W, for instance Cu-Cr-Mo, Cu-Mo-W and Cu-Cr-Mo-W. While the above embodiments are concerned with alloys composed solely of Cu and two or more elements of a group consisting of Cr, Mo, and W, similar effects on the uniformity and fineness of grain structure can be obtained with low chopping current vacuum circuit breaker contact which is obtained by adding low-melting metals such as Bi, Te, Sb, Tl, and Pb to the alloys mentioned above. Further, it is found that the low-melting metals will not be coagulated but are uniformly and finely distributed and that low chopping current can always be maintained irrespective of the number of times that the load is broken. Further, similar effects may be obtained by incorporating Cr, Mo, and W in the form of alloys or intermetallic compounds with other metals.

The uniform, fine alloy structure is thought to be obtained when the following requirements are met.

(1) The alloy contains Cu as a first component and two or more elements of the group of Cr, Mo, and W. Cr, Mo, and W each have a complete solid solution system.

(2) By the sintering process this occurs at temperatures above the melting point of Cu (1,083° C.) as well as at temperatures below the melting point.

In conclusion, the uniformity and fineness of grain structure is thought to be based on the formation of a complete solid solution of the elements of the group consisting of Cr, Mo and W and also the effect of diffusion of these members.

What is claimed is:

1. An alloy metal contact for a vacuum circuit breaker consisting essentially of copper as a first component and two or more elements of the group of chromium, molybdenum, and tungsten as the other components, each of said other components being contained in an amount effective to produce a contact having high breakdown voltage and high electrical current characteristics, when used as a component of a vacuum circuit breaker, but not in amounts higher than 40% by weight of the alloy.

2. The contact for a vacuum circuit breaker according to claim 1, wherein said other components are chromium and tungsten, chromium being in an amount of 10 to 40% by weight, and tungsten being in an amount of 0.3 to 15% by weight.

3. The contact for a vacuum circuit breaker according to claim 1, which further contains at least one element having a low-melting point of the group of bismuth, tellurium, antimony, thallium, and zinc, and alloys and intermetallic compounds of these low-melting metals in an amount not greater than 20% by weight.

4. The contact for a vacuum circuit breaker according to claim 2, which further contains at least one element having a low-melting point of the group of bismuth, tellurium, antimony, thallium, and zinc, and alloys and intermetallic compounds of these low-melting metals in an amount not greater than 20% by weight.

* * * * *